US007137203B2

(12) United States Patent
Bressler et al.

(10) Patent No.: US 7,137,203 B2
(45) Date of Patent: Nov. 21, 2006

(54) SHAVING APPARATUS

(75) Inventors: Peter Bressler, Philadelphia, PA (US); David Schiff, Highland Park, NJ (US); Andrew Pennella, Stamford, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

(21) Appl. No.: 10/749,701

(22) Filed: Dec. 30, 2003

(65) Prior Publication Data

US 2005/0144786 A1 Jul. 7, 2005

(51) Int. Cl.
*B26B 21/44* (2006.01)
*B26B 21/52* (2006.01)

(52) U.S. Cl. ..... 30/41; 30/535; 30/538

(58) Field of Classification Search ..... 30/41, 30/41.5, 123, 535, 538; 222/191
See application file for complete search history.

(56) References Cited

U.S. PATENT DOCUMENTS

| | | | | | |
|---|---|---|---|---|---|
| 1,899,841 | A | | 2/1933 | Acken | 30/41 |
| 2,686,361 | A | * | 8/1954 | Resnick et al. | 30/41 |
| 2,839,224 | A | * | 6/1958 | Lipka | 222/191 |
| 2,866,265 | A | * | 12/1958 | Kells | 30/41 |
| 3,053,422 | A | | 9/1962 | Tenison | 222/399 |
| 3,417,468 | A | * | 12/1968 | Miyauchi | 30/41 |
| 3,703,765 | A | | 11/1972 | Perez | 30/41 |
| 3,726,009 | A | | 4/1973 | Hackmyer | 30/41 |
| 4,023,269 | A | | 5/1977 | Lopez, Jr. | 30/41 |
| 4,077,119 | A | | 3/1978 | Sellera | 30/41 |
| 4,177,556 | A | | 12/1979 | Galli, Jr. | 30/41 |
| 4,228,587 | A | * | 10/1980 | Bennett | 30/41 |
| 4,377,034 | A | | 3/1983 | Druash et al. | 30/41 |
| 4,433,483 | A | | 2/1984 | Lazarus | 30/41 |
| 4,562,643 | A | | 1/1986 | Cataudella | 30/41 |
| 4,753,006 | A | | 6/1988 | Howe | 30/41 |
| 4,760,642 | A | | 8/1988 | Kwak | 30/123 |
| 4,791,723 | A | | 12/1988 | Jacobson | 30/41 |
| 4,809,432 | A | | 3/1989 | Schauble | 30/41 |
| 4,813,138 | A | | 3/1989 | Chen | 30/41 |
| 4,868,982 | A | | 9/1989 | McComas | 30/41 |
| 4,888,868 | A | | 12/1989 | Pritchard | 30/41 |
| 4,908,945 | A | | 3/1990 | Jacobson | 30/41 |
| 4,974,319 | A | | 12/1990 | Maguire, Jr. et al. | 30/41 |
| 5,014,427 | A | | 5/1991 | Byrne | 30/41 |
| 5,016,351 | A | | 5/1991 | Drahus | 30/41 |
| 5,092,041 | A | | 3/1992 | Podolsky | 30/41 |
| 5,103,560 | A | | 4/1992 | Podolsky | 30/41 |
| 5,168,628 | A | | 12/1992 | Mock et al. | 30/41 |

(Continued)

FOREIGN PATENT DOCUMENTS

DE 1045282 B 11/1958

(Continued)

OTHER PUBLICATIONS

PCT Search Report for Serial No. PCT/IB03/01144 dated Oct. 29, 2003.

*Primary Examiner*—Hwei-Siu Payer
(74) *Attorney, Agent, or Firm*—Michaud-Duffy Group LLP

(57) ABSTRACT

A shaving apparatus includes a razor blade, a reservoir for containing a non-solid shaving aid material, at least one conduit extending between the reservoir and one or more ports, and a pump in fluid communication with one or both of the reservoir and the conduit. Movement of the razor blade actuates the pump, and the pump transfers shaving aid material from the reservoir to the one or more ports.

7 Claims, 2 Drawing Sheets

U.S. PATENT DOCUMENTS

| | | | | |
|---|---|---|---|---|
| 5,234,140 | A | 8/1993 | Demarest et al. | 222/394 |
| 5,384,961 | A | 1/1995 | Gregory | 30/41 |
| 5,402,697 | A * | 4/1995 | Brooks | 83/18 |
| 5,564,190 | A | 10/1996 | Fleetwood | 30/41 |
| 5,673,485 | A | 10/1997 | Hill | 30/41.5 |
| 5,701,674 | A | 12/1997 | Mitchell | 30/41 |
| 5,761,813 | A | 6/1998 | Frick et al. | 30/41 |
| 5,855,066 | A | 1/1999 | Manger | 30/41 |
| 5,983,500 | A | 11/1999 | da Silva | 30/41 |
| 6,131,288 | A * | 10/2000 | Westerhof et al. | 30/41 |
| 6,594,905 | B1 * | 7/2003 | Furst et al. | 30/41 |
| 6,665,937 | B1 * | 12/2003 | Furst et al. | 30/41 |
| 6,754,958 | B1 * | 6/2004 | Haws et al. | 30/41 |
| 6,789,321 | B1 * | 9/2004 | Simms | 30/41 |
| 6,925,716 | B1 * | 8/2005 | Bressler et al. | 30/41 |
| 2004/0177510 | A1 * | 9/2004 | Pennella | 30/41 |
| 2005/0120560 | A1 * | 6/2005 | Franzini et al. | 30/41 |
| 2005/0120561 | A1 * | 6/2005 | Franzini et al. | 30/41 |

FOREIGN PATENT DOCUMENTS

| | | | |
|---|---|---|---|
| EP | 115272 | A | 11/2001 |
| EP | 1252980 | A | 10/2002 |
| GB | 2 246 314 | A | 1/1992 |
| JP | 10-165668 | | 6/1998 |
| JP | 2003210874 | | 7/2003 |
| WO | WO 00/10780 | | 3/2000 |
| WO | WO 00/47374 | | 8/2000 |
| WO | WO 02/32253 | A1 | 4/2002 |

* cited by examiner

SHAVING APPARATUS

BACKGROUND OF THE INVENTION

1. Technical Field

The present invention relates to shaving apparatuses in general, and, more particularly, to shaving apparatuses having mechanisms for providing flowable shaving aid materials.

2. Background Information

The process of removing hair from a dermal surface typically includes the application of a shaving aid material (e.g., shaving cream) to the surface and the separate step of shaving the hair using a razor assembly. The shaving aid material oftentimes includes at least one suitable agent (e.g., a lubricating agent, a drag-reducing agent, a depilatory agent, etc.) that enhances the shaving process. The razor assembly is generally a safety razor having a disposable razor cartridge having at least one razor blade.

Numerous attempts have been made to combine razor assemblies and mechanisms for dispensing shaving aid materials into unitary shaving apparatuses. Typically, a shaving apparatus that is a combination of a razor assembly and a dispensing mechanism will include a reservoir containing the shaving aid material and one or more passages connecting the reservoir to a point of discharge. The shaving aid material is deposited on the surface being shaved at the point at which the shaving aid material is discharged from the passage(s).

A conventional mechanism for dispensing the shaving aid material from the reservoir includes a source of pressurized gas. Pressurized mechanisms, however, are often costly to manufacture and necessitate additional replacement items. Mechanical systems for powering shaving aid material from the reservoir are also available. They typically require the user to provide some type of actuation in addition to the normal shaving stroke. Hence, the ease of shaving is negatively affected. What is needed, therefore, is a shaving apparatus that dispenses shaving aid material without the aforesaid disadvantages of the prior art.

DISCLOSURE OF THE INVENTION

According to the present invention, a shaving apparatus is provided that includes one or more razor blades, a reservoir for containing a non-solid shaving aid material, at least one conduit extending between the reservoir and one or more ports disposed proximate the razor blade, and a pump in fluid communication with one or both of the reservoir and the conduit, wherein movement of the one or more razor blades actuates the pump, and the pump transfers shaving aid material from the reservoir to the one or more ports.

According to one aspect of the present invention, the pump includes a reciprocating mechanism having a sleeve, a stem that translates along a length of the sleeve in a first direction to provide a pressure stroke, and a spring operably disposed at the sleeve to bias the stem in a second direction to provide a return stroke. According to another aspect of the present invention, the pump includes a reciprocating mechanism having a bellows defined by a plurality of flexible pleats collapsible in a first direction to provide a pressure stroke and expandable in a second direction to provide a return stroke.

One advantage of the present invention is that the shaving operation may be effected in a single step. More specifically, the shaving aid material is dispensed as needed to the hair to be cut as the blade is drawn across the surface to be shaved, i.e., in response to the shaving stroke. By dispensing and applying the shaving aid material in response to the shaving stroke, the need for the separate step of applying the shaving aid material is eliminated. Furthermore, the potential for the shaving aid material to be prematurely washed away (if the shaving operation takes place in a wet environment such as a shower) is minimized.

Another advantage is that because the shaving aid material is applied just prior to the blades, maximum lubricity is achieved, which in turn affords the person being shaved maximum comfort.

These and other objects, features, and advantages of the present invention will become apparent in light of the detailed description of the present invention.

DETAILED DESCRIPTION OF THE INVENTION

Figure 3:
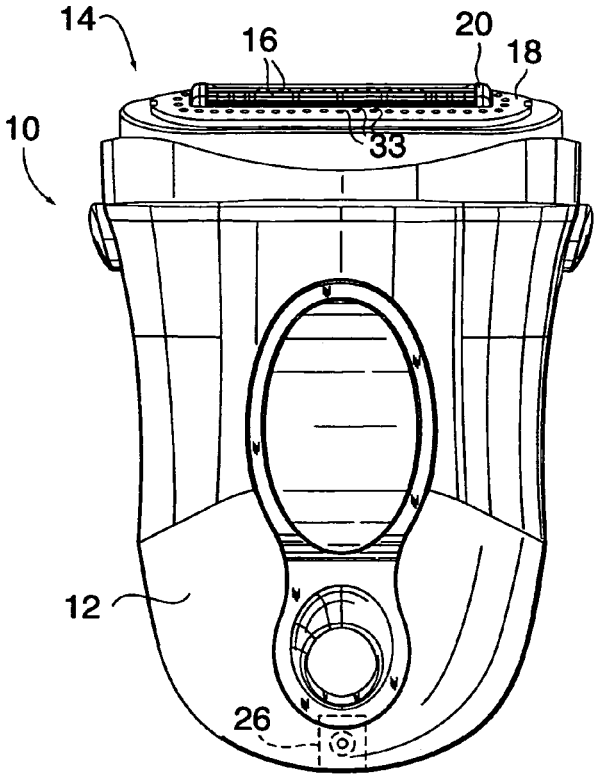
FIG. 3 is a plan view of the shaving apparatus of FIG. 1 showing the positioning of a valve in the handle of the shaving apparatus.
Figure 1:
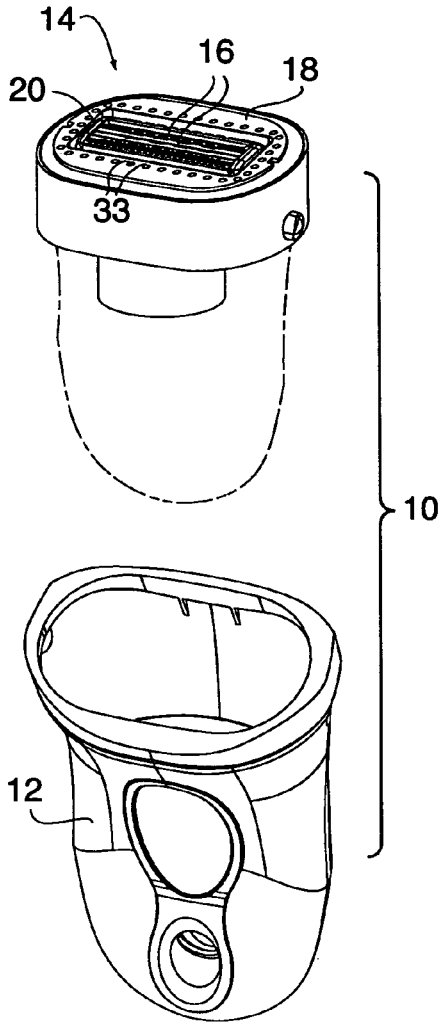
FIG. 1 is an exploded perspective view of a shaving apparatus.
Figure 2:
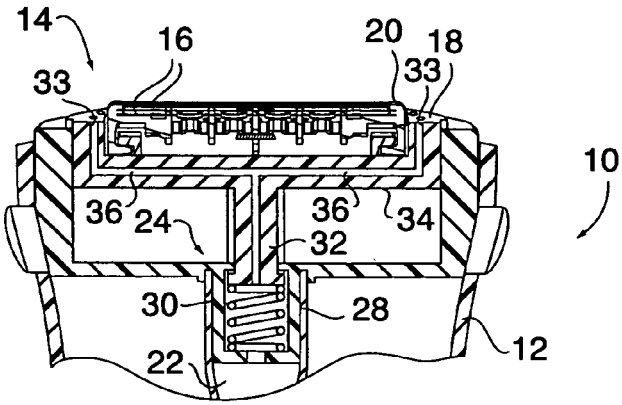
FIG. 2 is a sectional view of the shaving apparatus of FIG. 1 showing a pump.

Referring now to FIGS. 1 through 3, a shaving apparatus is shown generally at 10. The shaving apparatus includes a handle 12 that defines a reservoir 22 (FIG. 2) in which a non-solid shaving aid material is contained, a head assembly 14 disposed in an opening at an operable end of the handle 12, at least one razor blade 16 mounted adjacent an anterior surface 18 of the head assembly 14, and a pump 24 (FIG. 2) disposed in operable communication with the reservoir 22 to transfer the shaving aid material to at least the anterior surface 18 of the head assembly 14. A one-way valve 26 (FIG. 3) may be disposed in the handle 12 to permit ambient air to enter the reservoir upon operation of the pump 24. The handle 12 is preferably ergonomically designed to provide comfort to the shaver during a shaving operation. The at least one razor blade 16 may be mounted directly to the head assembly 14, or it may be mounted in a replaceable razor cartridge 20, which is mounted in the head assembly 14. The razor cartridge 20 may be configured to pivot to accommodate the contours of a surface being shaved.

The pump 24, which comprises a mechanism that operates in response to a reciprocating motion, is disposed at an effluent end of the reservoir 22. The reciprocating mechanism of one embodiment of the pump 24 includes a hollow sleeve 28 and a biasing mechanism (e.g., spring 30) disposed along a length of the sleeve 28. In one embodiment, the spring 30 is disposed within the sleeve 28, and the sleeve 28 is configured to receive a hollow stem 32 depending from a posterior surface 34 of the head assembly 14. In an alternate embodiment, the spring 30 is disposed outside the sleeve 28, and the stem 32 is configured to be received along the outside of the sleeve 28. In either embodiment, the operable connection of the spring 30 with the sleeve 28 and with the stem 32 enables the head assembly 14 to "float" within the opening at the operable end of the handle 12. Conduits 36 extend from the hollow of the stem 32 to ports 33 at the anterior surface 18 of the head assembly 14 to provide fluid communication between the reservoir 22 and the surface being shaved.

In the operation of the shaving apparatus 10 having the above-described embodiment of the pump 24, the shaving aid material is dispensed to a surface being shaved via movement of the head assembly 14, which in turn actuates the pump 24. The movement of the head assembly 14 (including the razor cartridge 20 in some embodiments) is effected by applying pressure to the anterior surface 18 (and/or the razor cartridge 20); e.g., by pressing the at least one razor blade 16 against the surface to be shaved. By applying pressure to the anterior surface 18, the stem 32 translates along the sleeve 28 in a first direction against the bias of the spring 30 (i.e., in a pressure stroke), thereby pressurizing the reservoir 22 and transferring the shaving aid material through the sleeve 28 and the stem 32 and through the conduits 36 to the ports 33. When the pressure applied to the anterior surface 18 is released and the bias of the spring 30 causes the stem 32 to translate in a second direction to retract from the sleeve 28 (i.e., in a return stroke) and return to its pre-pressure stroke position, the pressure differential causes the one-way valve 26 to open and allow air to be drawn within the reservoir 22, thereby equalizing the pressure in the reservoir 22.

Figure 4:
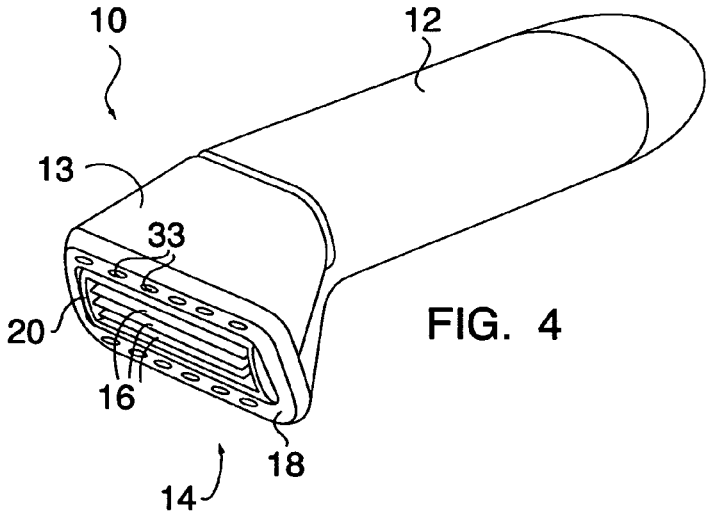
FIG. 4 is a perspective view of an alternate embodiment of a shaving apparatus.
Figure 5:
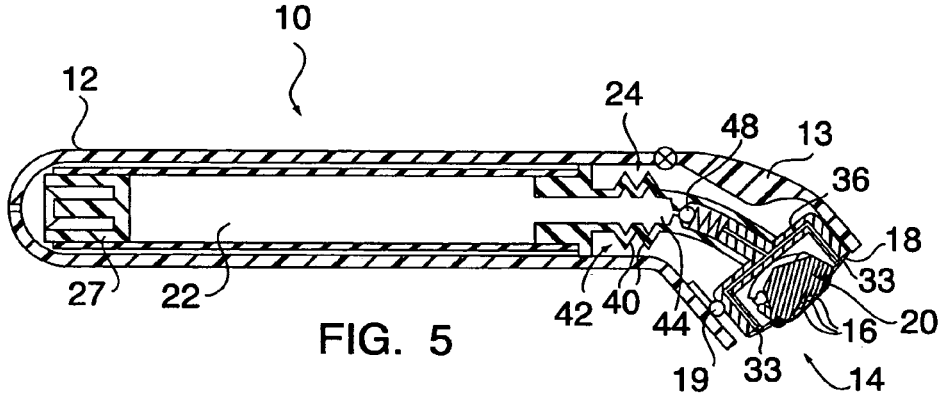
FIG. 5 is a sectional view of the shaving apparatus of FIG. 4 showing a bellows pump.
Figure 6:
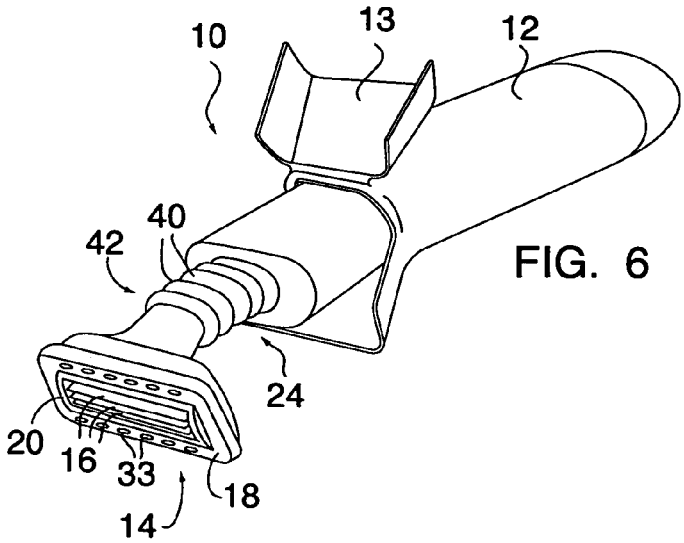
FIG. 6 is a perspective view of the shaving apparatus of FIGS. 4 and 5 showing a hinged door positioned on the handle of the shaving apparatus in an open position.

Another embodiment of the shaving apparatus 10 is shown with reference to FIGS. 4 through 6. As above, the shaving apparatus 10 includes the handle 12, the reservoir 22 disposed within the handle 12, the head assembly 14 disposed in the opening at the operable end of the handle 12, at least one razor blade 16 mounted proximate ports 33 at the anterior surface 18 of the head assembly 14, and the pump 24. The pump 24, however, comprises a bellows 42. In the embodiment shown in FIGS. 5 and 6, the bellows is disposed within a section of the passage 44 extending between the reservoir 22 and the head assembly 14. The bellows 42 includes a series of pleats 40. The pleats 40 enable the bellows 42 to flex in an axial direction in response to a reciprocating motion. The pleats 40 also provide a biasing mechanism to return the bellows to its original or rest position. The pleats 40 may provide the biasing mechanism by virtue of incorporating a resilient material, and/or having a spring-type mechanical member attached thereto. The bellows 42 is disposed in operable communication with the reservoir 22 to transfer the shaving aid material to the ports 33 at the anterior surface 18 of the head assembly 14. A piston 27 is preferably used to decrease the volume of the reservoir 22 as shaving aid material from the reservoir 22 upon operation of the pump 24. In some embodiments, the handle 12 includes a hinged door 13 disposed proximate the operable end of the shaving apparatus 10 to allow for the insertion and removal of a replacement cartridge that includes the reservoir 22, the bellows, and the head assembly 14. As above, the handle 12 may be ergonomically designed and the at least one razor blade 16 may be mounted directly at the anterior surface 18 or mounted in a replaceable razor cartridge 20 and mounted in the head assembly 14. The pleats 40 of the bellows may enable the head assembly 14 to float freely in the opening. Alternately, the head assembly 14 may be pivotally mounted at a pivot point 19, as is shown in FIG. 5.

The shaving aid material is transferred from the reservoir 22 by the bellows 42 of the pump 24. The outlet end of the pump 24, which is downstream of the pleats 40, is disposed in fluid communication with the anterior surface 18 of the head assembly 14 through passage 44, conduits 36, and ports 33.

In some embodiments, a check valve 48 is disposed in the passage 44 between the head assembly 14 and the pump 24. The check valve 48 permits shaving aid material flow toward the head assembly 14, and prevents air, shaving aid material. Etc., from passing into the reservoir 22. For example, in the embodiment shown in FIG. 5, the check valve 48 is disposed between the head assembly 14 and the bellows 42.

To operate the pump 24, the series of pleats 40 is alternately collapsed and expanded. Collapsing of the pleats 40 is effected in response to a pressure applied at the razor cartridge 20 disposed in the head assembly 14. Upon such collapsing of the pleats 40 (which provides a pressure stroke), the reservoir 22 is pressurized and the shaving aid material is forced through the pump 24, through the passage 44, conduits 36, and to the ports 33 at the anterior surface 18. The subsequent expanding of the pleats 40 (which provides a return stroke) is effected in response to the elasticity of the bellows 42 and to the release of the pressure applied to the razor cartridge 20. When the pressure applied at the razor cartridge 20 is released and the return stroke is initiated, the resulting pressure differential causes the piston 27 to be drawn within the reservoir 22, thereby decreasing the volume of the reservoir 22.

Although this invention has been shown and described with respect to the detailed embodiments thereof, it will be understood by those of skill in the art that various changes may be made and equivalents may be substituted for elements thereof without departing from the scope of the invention. For example, it will be understood by those of skill in the art that configurations of razor blades other than those shown disposed in the razor cartridge are applicable to the above-described embodiments. Furthermore, it will be understood that pump configurations other than those described are likewise applicable to the above-described embodiments.

The invention claimed is:

1. A shaving apparatus, comprising:

one or more razor blades;

a reservoir for containing a non-solid shaving aid material;

at least one conduit extending between the reservoir and one or more ports; and a pump in fluid communication with one or both of the reservoir and the conduit, wherein a reciprocal movement of the one or more razor blades relative to the reservoir actuates the pump, and the pump transfers shaving aid material from the reservoir to the one or more ports.

2. The shaving apparatus of claim 1, wherein the one or more razor blades are mounted in a head assembly.

3. The shaving apparatus of claim 1, wherein the one or more razor blades are mounted in a razor cartridge.

4. The shaving apparatus of claim 3, further comprising a valve disposed in fluid communication with the reservoir.

5. The shaving apparatus of claim 4, wherein the valve is a one-way valve operable to permit the entry of ambient air into the reservoir upon operation of the pump.

6. The shaving apparatus of claim 3, wherein the razor cartridge is pivotally mounted in a head assembly.

7. The shaving apparatus of claim 1, wherein the reciprocal movement of the one or more razor blades is effected by the pump comprising a sleeve, a stem that translates along a length of the sleeve in a first direction to provide a pressure stroke, and a spring operably disposed at the sleeve to bias the stem in a second direction to provide a return stroke.

* * * * *